US009447760B2

(12) United States Patent
Kronberger et al.

(10) Patent No.: US 9,447,760 B2
(45) Date of Patent: Sep. 20, 2016

(54) DRIVE DEVICE FOR AN INJECTION VALVE, AND INJECTION VALVE

(75) Inventors: Maximilian Kronberger, Steyr (AT); Hellmut Freudenberg, Pentling/Grossberg (DE); Jürgen Dick, Laaber (DE); Wolfgang Wechler, Regensburg (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 662 days.

(21) Appl. No.: 13/817,498

(22) PCT Filed: Aug. 16, 2011

(86) PCT No.: PCT/EP2011/064111

§ 371 (c)(1),
(2), (4) Date: Feb. 18, 2013

(87) PCT Pub. No.: WO2012/022752

PCT Pub. Date: Feb. 23, 2012

(65) Prior Publication Data

US 2013/0153678 A1 Jun. 20, 2013

(30) Foreign Application Priority Data

Aug. 18, 2010 (DE) ..... 10 2010 039 478

(51) Int. Cl.
*F02M 51/06* (2006.01)
*F02M 63/00* (2006.01)

(52) U.S. Cl.
CPC ..... *F02M 51/0603* (2013.01); *F02M 63/0026* (2013.01); *F02M 2200/701* (2013.01); *F02M 2200/702* (2013.01)

(58) Field of Classification Search
CPC ..... F02M 51/0603; F02M 51/0642; F02M 51/066; F02M 51/0685; F02M 2200/70; F02M 2200/701
See application file for complete search history.

(56) References Cited

U.S. PATENT DOCUMENTS

| | | | | |
|---|---|---|---|---|
| 6,595,436 | B2 * | 7/2003 | Kirzhner et al. | 239/102.2 |
| 7,225,790 | B2 * | 6/2007 | Bartunek et al. | 123/294 |
| 2003/0160202 | A1 | 8/2003 | Boecking | 251/229 |
| 2004/0119377 | A1 * | 6/2004 | Frank et al. | 310/323.09 |

FOREIGN PATENT DOCUMENTS

| | | | | |
|---|---|---|---|---|
| DE | 102004044154 | A1 * | 3/2006 | |
| WO | 02/057622 | A1 | 7/2002 | F02M 47/02 |

(Continued)

OTHER PUBLICATIONS

International Search Report and Written Opinion, Application No. PCT/EP2011/064111, 16 pages, Sep. 26, 2011.

*Primary Examiner* — Ryan Reis
(74) *Attorney, Agent, or Firm* — Slayden Grubert Beard PLLC

(57) ABSTRACT

A drive device for an injection valve may include an actuator configured for exerting a force along a first force action axis, a lever device coupled to the actuator, an output element coupled to the lever device and configured for absorbing a force from the lever device along a second force action axis, wherein the first and second force action axes are arranged offset with respect to one another, and a transmission element arranged between the actuator and the lever device. The transmission element may be coupled to the actuator in a first contact region and to the lever device in a second contact region. The first contact region of the transmission element may be arranged such that it is penetrated by the first force action axis. The second contact region of the transmission element may be arranged such that it is penetrated by the second force action axis.

14 Claims, 3 Drawing Sheets

(56) References Cited

FOREIGN PATENT DOCUMENTS

| | | | | |
|---|---|---|---|---|
| WO | 2004/109087 A1 | 12/2004 | ..... | B05B 1/08 |
| WO | 2008/071636 A1 | 6/2008 | ..... | F02M 51/06 |
| WO | 2009/019178 A1 | 2/2009 | ..... | F02M 51/06 |
| WO | 2012/022752 A1 | 2/2012 | ..... | F02M 63/00 |

* cited by examiner

DRIVE DEVICE FOR AN INJECTION VALVE, AND INJECTION VALVE

CROSS-REFERENCE TO RELATED APPLICATIONS

This application is a U.S. National Stage Application of International Application No. PCT/EP2011/064111 filed Aug. 16, 2011, which designates the United States of America, and claims priority to DE Application No. 10 2010 039 478.5 filed Aug. 18, 2010, the contents of which are hereby incorporated by reference in their entirety.

TECHNICAL FIELD

The disclosure relates to a drive device for an injection valve, having an actuator, a lever device, a drive output element and a transmission element. The disclosure also relates to an injection valve.

BACKGROUND

Ever more stringent legal regulations with regard to the admissible pollutant emissions of internal combustion engines used in motor vehicles make it necessary to implement various measures for lowering pollutant emissions. The formation of pollutants is highly dependent on the preparation of the air/fuel mixture in the respective cylinder of the internal combustion engine. Correspondingly improved mixture preparation can be attained if the fuel is metered in at very high pressure. For diesel internal combustion engines, the fluid pressures are over 2000 bar. In particular in the case of internal combustion engines, high demands are placed on the precision of the injection valve.

SUMMARY

One embodiment provides a drive device for an injection valve which has an actuator designed to exert a force along a first axis of force action, a lever device which is mechanically coupled to the actuator, a drive output element which is mechanically coupled to the lever device and which is designed to absorb a force from the lever device along a second axis of force action, wherein the second axis of force action is arranged offset with respect to the first axis of force action, and a transmission element which is arranged between the actuator and the lever device, which transmission element is coupled in a first contact region to the actuator and in a second contact region to the lever device, wherein the first contact region of the transmission element is arranged so as to be intersected by the first axis of force action, and the second contact region of the transmission element is arranged so as to be intersected by the second axis of force action.

In a further embodiment, the transmission element is of convexly curved design in the first contact region and/or in the second contact region. In a further embodiment, the transmission element is of substantially hemispherical design in the first contact region and/or in the second contact region. In a further embodiment, the transmission element is, in the first contact region and/or in the second contact region, of substantially hemispherical design with a radius considerably smaller than half of a distance between the first contact region and the second contact region. In a further embodiment, the transmission element is, in the first contact region and/or in the second contact region, designed substantially as a spherical segment, and the spherical segment has a radius greater than half of the distance between the first contact region and the second contact region. In a further embodiment, the transmission element is designed in the form of a pin.

Another embodiment provides an injection valve including a drive device as disclosed above.

BRIEF DESCRIPTION OF THE DRAWINGS

Exemplary embodiments will be explained in more detail below on the basis of the schematic drawings, wherein.

DETAILED DESCRIPTION

Figure 1:
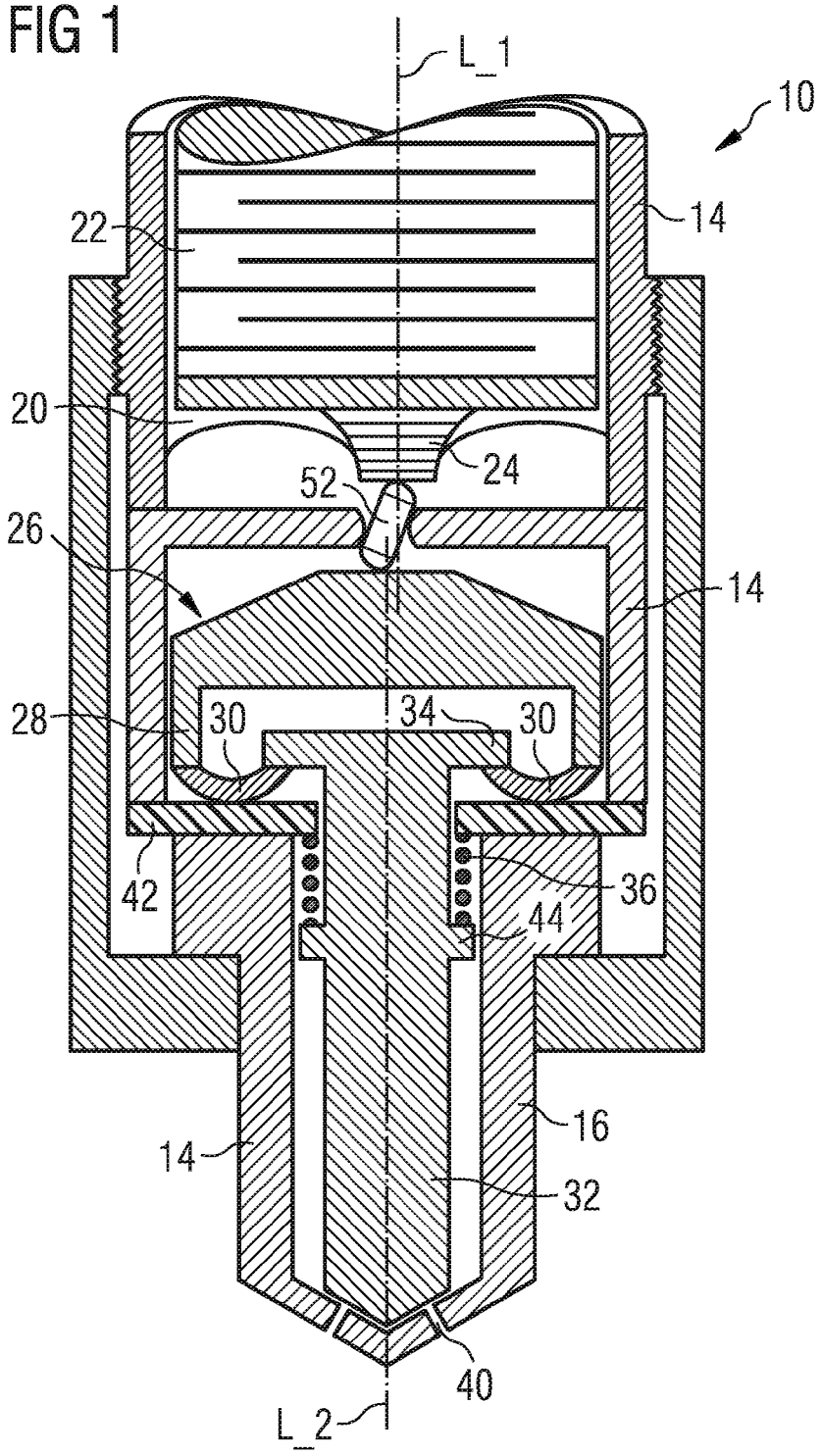
FIG. 1 shows a sectional view of an injection valve.

Embodiments of the present disclosure provide a drive device for an injection valve, which drive device exhibits permanently reliable operation. Some embodiments provide an injection valve having a drive device, which injection valve permits a reliable metering-in of fluid.

Some embodiments provide a drive device for an injection valve which has an actuator, a lever device, a drive output element and a transmission element. The actuator is designed to exert a force along a first axis of force action. The lever device is mechanically coupled to the actuator. The drive output element is mechanically coupled to the lever device and is designed to absorb a force from the lever device along a second axis of force action. The second axis of force action is arranged offset with respect to the first axis of force action. The transmission element is arranged between the actuator and the lever device. The transmission element is coupled in a first contact region to the actuator and in a second contact region to the lever device. The first contact region of the transmission element is arranged so as to be intersected by the first axis of force action. The second contact region of the transmission element is arranged so as to be intersected by the second axis of force action.

A possible advantage of such a drive device is that guidance of force between the first axis of force action and the second axis of force action can be realized in a targeted manner even if the second axis of force action is arranged offset with respect to the first axis of force action. It is thus possible to attain an expedient introduction of force both into the actuator and also into the lever device. Another possible advantage is that a drive device of said type exhibits virtually no friction and no wear. The characteristics of the drive device can thus remain virtually permanently unchanged.

In one embodiment of the drive device, the transmission element is of convexly curved design in the first contact region and/or in the second contact region. This has the advantage that the first contact region and/or the second contact region can be designed to be very small. The friction and the wear on the drive device can be very low because the convexly curved surfaces of the transmission element permit a rolling motion. Furthermore, angular deviations between the axes of force action can be compensated.

In a further embodiment of the drive device, the transmission element is of substantially hemispherical design in the first contact region and/or in the second contact region. This has the advantage that the contact regions can be very small.

In a further embodiment of the drive device, the transmission element is, in the first contact region and/or in the second contact region, of substantially hemispherical design with a radius considerably smaller than half of a distance between the first contact region and the second contact region. This has the advantage that the contact regions can be very small.

In a further embodiment of the drive device, the transmission element is, in the first contact region and/or in the second contact region, designed substantially as a spherical segment. The spherical segment has a radius greater than half of the distance between the first contact region and the second contact region. This has the advantage that high contact forces can permanently be transmitted.

In a further embodiment of the drive device, the transmission element is designed in the form of a pin. This has the advantage that the transmission element can have a low mass.

Other embodiments provide an injection valve which has a drive device according to the first aspect.

FIG. 1 shows an injection valve 10. The injection valve 10 has an injector body 14. The injector body 14 may have a multi-part form and has a first recess 16. The first recess 16 can be coupled to a high-pressure circuit (not illustrated) for the fluid. Said first recess is coupled to the high-pressure circuit when the injection valve 10 is in an installed state.

The injector body 14 has a second recess 20 in which an actuator 22 is arranged. The actuator 22 is designed as a stroke actuator and may be a piezo actuator which comprises a stack of piezoelectric elements. The piezo actuator changes its axial extent as a function of an applied voltage signal. The actuator 22 may however also be designed as some other actuating drive known to a person skilled in the art as being suitable for this purpose, in particular as a solenoid.

The actuator 22 has a piston 24. The actuator 22 acts via the piston 24 on a lever device 26. The lever device 26 comprises a bell-shaped body 28 and lever elements 30. The bell-shaped body 28 and the lever elements 30 are arranged in the first recess 16. The bell-shaped body 28 is coupled to the lever elements 30. In the first recess 16 there is also arranged a drive output element 32. The drive output element 32 may be designed as a nozzle needle. In alternative embodiments, the drive output element 32 is formed as a separate component which is coupled to the nozzle needle. The drive output element 32 designed as a nozzle needle has a nozzle needle head 34. The lever elements 30 interact with the nozzle needle head 34 in order to axially move the drive output element 32.

A nozzle spring 36 is arranged between a support 42 of the injector body 14 and a shoulder 44 of the drive output element 32. The drive output element 32 designed as a nozzle needle is preloaded by means of the nozzle spring 36 in such a way that said drive output element, when in a closed position, prevents a fluid flow through at least one injection orifice 40, which is arranged in the injector body 14, when no other forces act on the drive output element 32. In the event of actuation of the actuator 22, the drive output element 32 designed as a nozzle needle is moved from its closed position into an open position in which it permits the flow of fluid through the at least one injection orifice 40.

FIGS. 2 to 5 show a drive device 50 of the injection valve 10 in detail. The drive device 50 has the actuator 22, the bell-shaped body 28, the lever elements 30, the drive output element 32 and a transmission element 52. The transmission element 52 is arranged between the actuator 22 and the lever device 26. The bell-shaped body 28 is thus coupled via the transmission element 52 to the actuator 22. In the embodiment shown here, the transmission element 52 is of pin-shaped design, such that it can have a low mass. The transmission element 52 may also, in other embodiments, have other suitable forms.

The actuator 22 can exert a force along a first axis of force action L_1. The lever device 26 with the bell-shaped body 28 and the lever elements 30 can exert a force on the drive output element 32 along a second axis of force action L_2. The second axis of force action L_2 is arranged offset with respect to the first axis of force action L_1.

The transmission element 52 is coupled in a first contact region K_1, which is intersected by the first axis of force action L_1, to the actuator 22. The transmission element 52 is furthermore coupled in a second contact region K_2, which is intersected by the second axis of force action L_2, to the lever device 26, in particular to the bell-shaped body 28. Since the second axis of force action L_2 is arranged offset with respect to the first axis of force action L_1, the transmission element 52 is arranged so as to be inclined relative to the axes of force action L_1, L_2.

Figure 3:
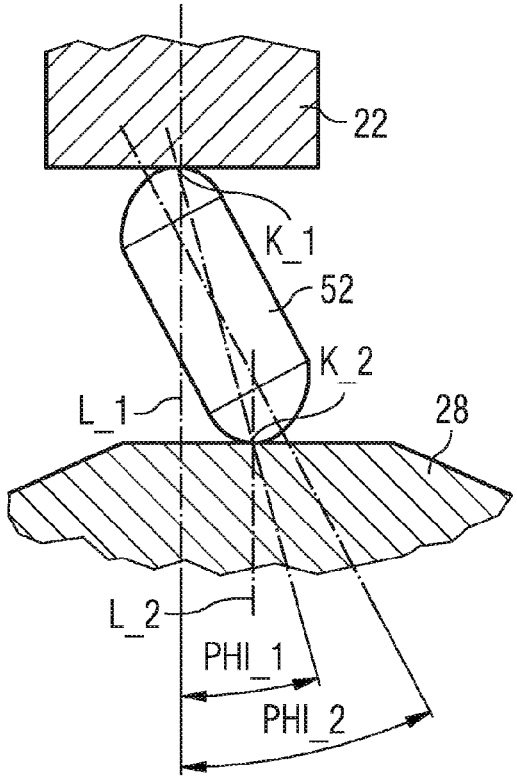
FIG. 3 shows a detail view of the drive device as per FIG. 2.
Figure 5:
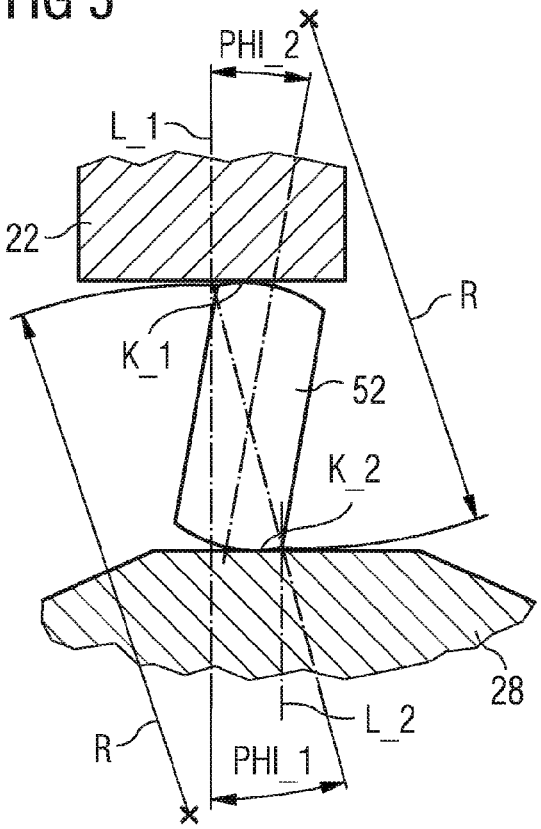
FIG. 5 shows a detail view of the drive device as per FIG. 4.

The force exerted by the actuator 22 along the first axis of force action L_1 can be conducted via the first contact region K_1 and the second contact region K_2 to the bell-shaped body 28 of the lever device 26. As can be seen in FIGS. 3 and 5, the force is conducted from the actuator 22 to the bell-shaped body 28 of the lever device 26 at a first angle PHI_1 relative to the axis of force action L_1 of the actuator 22. The force can then be conducted by the bell-shaped body 28 onward to the drive output element 32 along the second axis of force action L_2.

Figure 2:
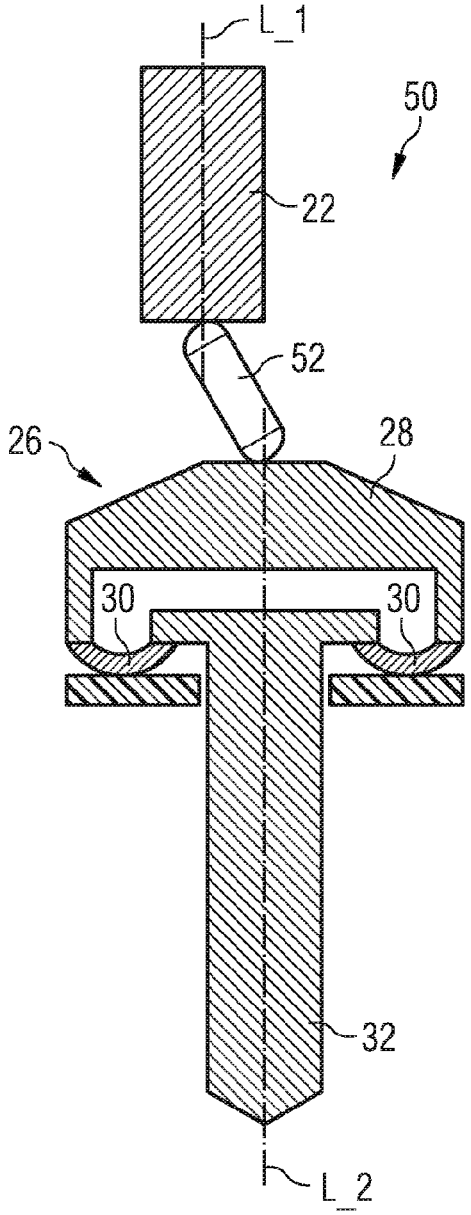
FIG. 2 is a schematic illustration of a first embodiment of a drive device of the injection valve.

FIGS. 2 and 3 show a first embodiment of the drive device 50 in which the transmission element 52 is of substantially hemispherical design in the first contact region K_1 and in the second contact region K_2, e.g., with a radius considerably smaller than half of the distance between the first contact region K_1 and the second contact region K_2. This yields, for the inclination of the transmission element 52 relative to the first axis of force action L_1, a second angle PHI_2 greater than the first angle PHI_1 (FIG. 3).

Figure 4:
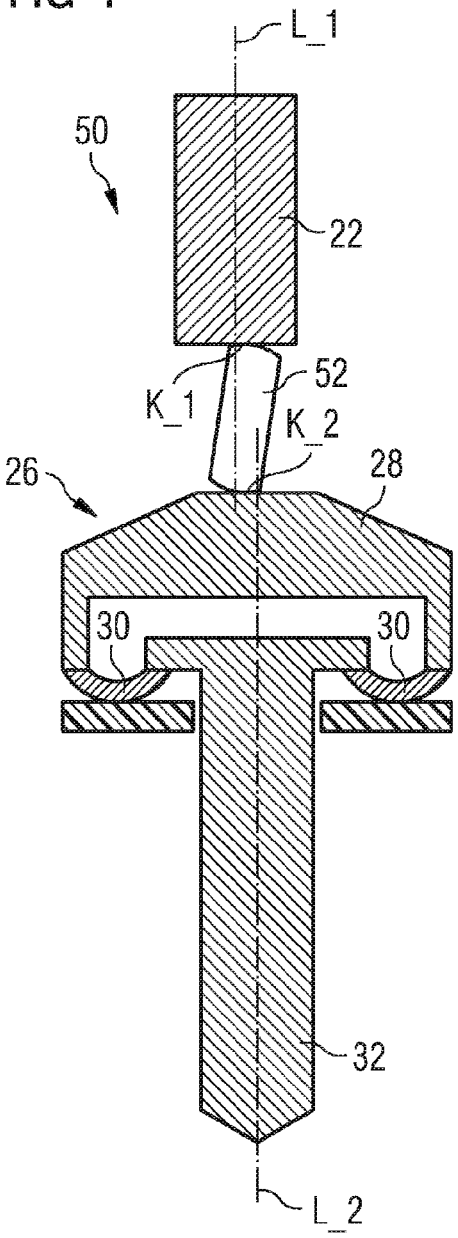
FIG. 4 is a schematic illustration of a further embodiment of the drive device.

In a further embodiment of the drive device 50 corresponding to FIGS. 4 and 5, the transmission element 52 is designed in the form of a spherical segment in the first contact region K_1 and in the second contact region K_2. The spherical segment has a radius R which, in the embodiment shown here, is greater than half of the distance between the first contact region K_1 and the second contact region K_2. The transmission element 52 is inclined relative to the first axis of force action L_1 of the actuator 22 by the second angle PHI_2. Since the radius R of the spherical segment is greater than half of the distance between the first contact region K_1 and the second contact region K_2, the transmission element 52 is, in this embodiment, inclined counter to the axis of the force transmission between the first contact region K_1 and the second contact region K_2. In this embodiment, the angle PHI_2 of the inclination of the transmission element 52 relative to the first axis of force action L_1 may be very small. The angle PHI_2 of the inclination of the transmission element 52 relative to the first axis of force action L_1 of the actuator 22 can be smaller the greater the radius R of the spherical segment is. The smaller the second angle PHI_2 of the inclination of the transmission element 52 relative to the first axis of force action L_1 of the actuator 22 is, the more favorable the production of the guide bore of the transmission element 52 can also be.

The greater the radius R of the spherical segment is, the higher the drive forces that can permanently be transmitted are.

The invention is not restricted to the exemplary embodiments specified. It is possible in particular for the features of the different exemplary embodiments to be combined with one another; such arrangements are therefore also encompassed by the invention.

What is claimed is:

1. A drive device for an injection valve, comprising:

an actuator configured to exert a force along a first axis of force action, a lever device mechanically coupled to the actuator via a transmission element and configured to receive a force from the actuator along a second axis of force action offset with respect to the first axis of force action, a drive output element mechanically coupled to the lever device and configured to absorb a force from the lever device, and the transmission element including first and second contact regions and arranged between the actuator and the lever device, the transmission element coupled in the first contact region to the actuator and coupled in the second contact region to the lever device, wherein the first contact region of the transmission element is intersected by the first axis of force action, the second contact region of the transmission element is intersected by the second axis of force action, and the drive output element is intersected by the first and second axes of force action.

2. The drive device of claim 1, wherein the transmission element comprises a convexly curved shape in at least one of the first and second contact regions.

3. The drive device of claim 1, wherein the transmission element comprises a substantially hemispherical shape in at least one of the first and second contact regions.

4. The drive device of claim 1, wherein at least one of the first and second contact regions of the transmission element comprises a substantially hemispherical shape with a radius substantially smaller than half of a distance between the first contact region and the second contact region.

5. The drive device of claim 1, wherein at least one of the first and second contact regions of the transmission element comprises a substantially spherical segment having a radius greater than half of a distance between the first contact region and the second contact region.

6. The drive device of claim 1, wherein the transmission element comprises a pin.

7. An injection valve including a drive device comprising:

an actuator configured to exert a force along a first axis of force action, a lever device mechanically coupled to the actuator and configured to receive a force along a second axis of force action offset with respect to the first axis of force action, a drive output element mechanically coupled to the lever device and configured to receive a force from the lever device, and a transmission element arranged between the actuator and the lever device, the transmission element coupled in a first contact region to the actuator and coupled in a second contact region to the lever device, wherein the first contact region of the transmission element and the drive output element are intersected by the first axis of force action, and the second contact region of the transmission element is intersected by the second axis of force action; and wherein at least one of the first and second contact regions of the transmission element comprises a substantially hemispherical shape with a radius substantially smaller than half of a distance between the first contact region and the second contact region.

8. The injection valve of claim 7, wherein at least one of the first and second contact regions of the transmission element comprises a substantially spherical segment having a radius greater than half of a distance between the first contact region and the second contact region.

9. The injection valve of claim 7, wherein the transmission element comprises a pin.

10. An injection valve, comprising:

a drive device comprising an actuator configured to exert a downward force along a first axis, a pin-shaped transmission element having first and second ends, the pin-shaped transmission element located underneath the actuator with the first end in contact with the actuator to receive the downward force exerted by the actuator along the first axis, a bell-shaped lever device located underneath and in contact with the transmission element, the lever device mechanically coupled to the actuator via the transmission element to receive the downward force from the actuator via the second end of transmission element along a second axis offset with respect to the first axis, a drive output element in contact with the bell-shaped lever device and configured to move upward in response to force received from the lever device, wherein the pin-shaped transmission element arranged between the actuator and the lever device consists of a first curved contact region on the first end and a second curved contact region on the second end, the first contact region intersected by the first axis and in contact with the actuator and the second contact region intersected by the second axis and in contact with the lever device.

11. The injection valve of claim 10, wherein the contact regions of the transmission element are convexly curved shaped.

12. The injection valve of claim 10, wherein the first and second contact regions of the transmission element are substantially hemispherical shaped.

13. The injection valve of claim 12, wherein the hemispherical shaped first and second contact regions of the transmission element comprise radiuses substantially smaller than half of a distance between the first contact region and the second contact region.

14. The injection valve of claim 10, wherein at least one of the first and second contact regions of the transmission element comprises a substantially spherical segment having a radius greater than half of a distance between the first contact region and the second contact region.

* * * * *